US005193699A

United States Patent [19]

Kaufhold et al.

[11] Patent Number: 5,193,699

[45] Date of Patent: Mar. 16, 1993

[54] CENTER SILL WITH SHORT YOKE MEMBER FOR CONVERTING FROM COUPLER TO DRAWBAR ARRANGEMENT WITHOUT MODIFYING CENTER SILL

[75] Inventors: Horst T. Kaufhold; John J. Steffen, both of Aurora, Ill.

[73] Assignee: AMSTED Industries Incorporated, Chicago, Ill.

[21] Appl. No.: 807,321

[22] Filed: Dec. 16, 1991

[51] Int. Cl.[5] ..... B61G 7/00

[52] U.S. Cl. ..... 213/75 R; 213/62 R; 213/67 A; 213/69

[58] Field of Search ..... 213/50, 61, 62 R, 62 A, 213/67 R, 67 A, 69, 70, 71, 72, 75 R

[56] References Cited

U.S. PATENT DOCUMENTS

| | | | |
|---|---|---|---|
| 3,708,076 | 1/1973 | Radwill | 213/69 X |
| 4,531,648 | 7/1985 | Paton | 213/50 |
| 4,589,558 | 5/1986 | Brodeur et al. | 213/62 R X |
| 4,681,040 | 7/1987 | Brodeur et al. | 213/62 R X |
| 4,700,853 | 10/1987 | Altherr et al. | 213/50 |
| 4,700,854 | 10/1987 | Chadwick | 213/50 X |
| 4,946,052 | 8/1990 | Kaim et al. | 213/62 R X |
| 5,115,926 | 5/1992 | Raufhold | 213/75 R X |

*Primary Examiner*—Robert J. Oberleitner

*Assistant Examiner*—S. Joseph Morano

*Attorney, Agent, or Firm*—Edward J. Brosius; F. S. Gregorczyk; Thomas J. Schab

[57] ABSTRACT

The present invention relates to a railway car coupler arrangement whereby a standard yoke, follower, and draft gear are removed from the center sill and replaced with a short yoke member, a spacer block member and slackless drawbar arrangement, namely, a pocket casting wedge shim, and follwer, easily converting the coupler arrangement to a drawbar arrangement without modifying the center sill. The short yoke member, spacer block and slackless arrangement fit exactly within the space formerly occupied by the draft gear pocket casing. The drawbar arrangement maintains the same degrees of angling freedom as the coupler since the drawbar is connected and pivoted from the same pin location as when the coupler was installed. The short yoke member is also designed to more uniformly distribute draft loads to the center sill by transferring forces from the connecting pin into the short yoke member, which in turn transfers those forces into abutting center sill front stops, left intact from the coupler arrangement. The present invention further provides a quick method for converting a broken coupler to a drawbar arrangement for towing back to a repair shop.

13 Claims, 2 Drawing Sheets

CENTER SILL WITH SHORT YOKE MEMBER FOR CONVERTING FROM COUPLER TO DRAWBAR ARRANGEMENT WITHOUT MODIFYING CENTER SILL

BACKGROUND OF THE INVENTION

This invention relates generally to railway coupler arrangements and more particularly to an improved slackless drawbar arrangement whereby the yoke, follower and draft gear in a standard coupler can be removed from a center sill and retrofitted with a short yoke drawbar connection thereby converting a railway coupling arrangement from coupler to drawbar and vice versa, without modifying the standard center sill.

Railway cars are connected together by coupler members, namely drawbars or couplers. Drawbars are integral units known to be used in the railroad industry to extend between and semipermanently connect two or more cars. Couplers are independent units in each car which interconnect with one another between adjacent cars to form a connection. In either arrangement, a shank and butt end of the drawbar or coupler extends into the center sill of a railway car where it is secured to transmit longitudinal loads to the car.

This invention is directed to an improvement in the center sill construction for conversion from standard coupler arrangements to slackless drawbar arrangements without modifying the center sill construction. By slackless, it is meant that the drawbar is received within the center sill in a manner to minimize longitudinal play or movement. However, because successive railway cars in a train must accommodate relative movement between cars when curves and inclines are negotiated, there must be provision for each car to move in pitch, yaw and roll modes with respect to the coupler member. Moreover, there must be a provision to remove the drawbar components for repair and or retrofitting an approved standard center sill to accept change out to a standard AAR-type coupling system, or vice versa.

In a slackless drawbar arrangement, the drawbar member is held in a way to eliminate or minimize longitudinal movement with respect to the car body. The slackless arrangement is usually accomplished by providing a tapered wedge between a rear wall of a pocket casting (secured in the center sill) and a follower block, which rests against the butt end of the drawbar member. The pocket casting rear outside wall bearing surface, in turn, abuts a set of center sill side wall rear stops for the purpose of indirectly transferring buff loads, while the drawbar pin typically transfers draft loads into the center sill side wall front stops. During draft loading, the wedge tends to move downward by gravity, maintaining a slack free system whereby the downward weight of the wedge forces the follower block away from the pocket casting end wall, firmly against the butt end of the coupler shank; all loads are then transferred through the coupler pin into the front stops. When cars are being pushed, the buff loads force compression of the coupler member against the follower, wedge, and pocket end wall, transferring the loads through these members into the rear stops. Examples of slackless drawbar systems are shown in Altherr et al., U.S. Pat. No. 4,700,853 and in Altherr et al, U.S. Pat. No. 4,456,133.

One problem with the slackless arrangements is that the front and rear center sill stops of the coupling system are rigidly secured, usually by welding, to the inside of the center sill. This results with a car being limited to strictly one type of coupler arrangement unless considerable time and expense is spent in removing the front stops when preparing the center sill for changeout to a standard coupler arrangement. It is advantageous in operating a railroad to have railway cars which can be converted from a standard coupler arrangement to a slackless drawbar arrangement without expensive modifications. Furthermore, it is desirable to have a drawbar retention arrangement which is removable yet utilizes the existing center sill front and rear stops so that distribution of buff and draft forces can be transferred more thoroughly throughout the center sill without sacrificing coupler angling performance.

SUMMARY OF THE INVENTION

Accordingly, an object of the present invention is to provide an improved drawbar retention arrangement which can be interchangeably retrofitted into a standard end sill by removing a standard coupler, yoke and draft gear, without modification to the center sill or end sill.

It is still another object of the present invention to provide a slackless retention arrangement where draft loads are more thoroughly and evenly distributed into the center sill.

DESCRIPTION OF THE PREFERRED EMBODIMENTS

Figure 1:
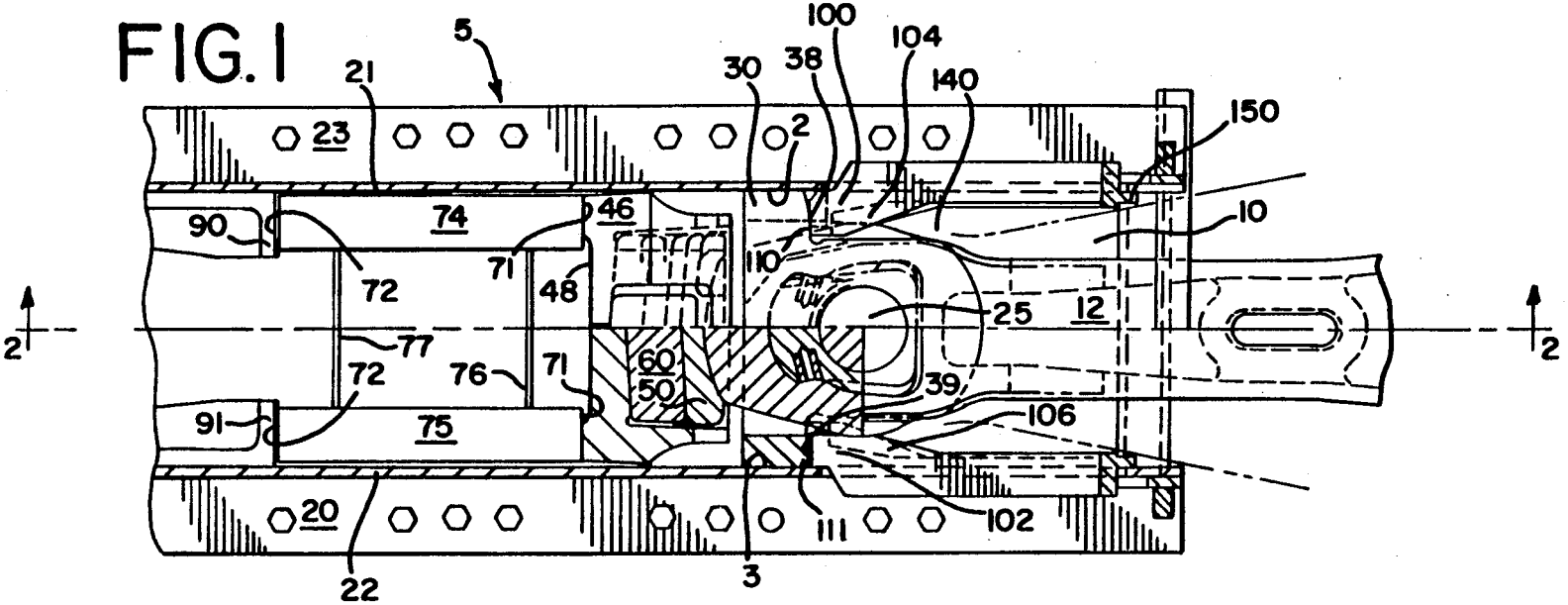
FIG. 1 is a section plan view of a preferred embodiment of the invention.
Figure 2:
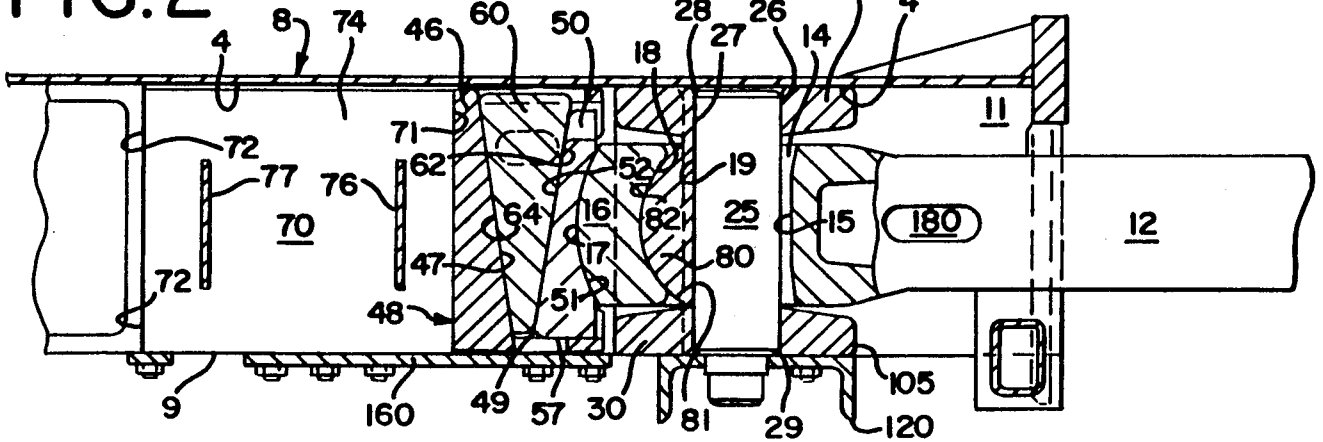
FIG. 2 is a side elevation of the apparatus, partially in section taken along lines 2—2 of FIG. 1 with certain parts broken away for clarity.
Figure 3:
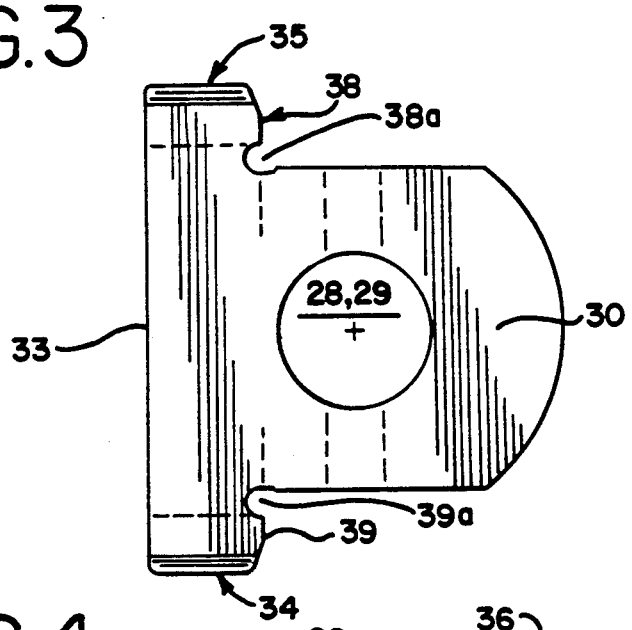
FIG. 3 is a top view of the short yoke connection.
Figure 4:
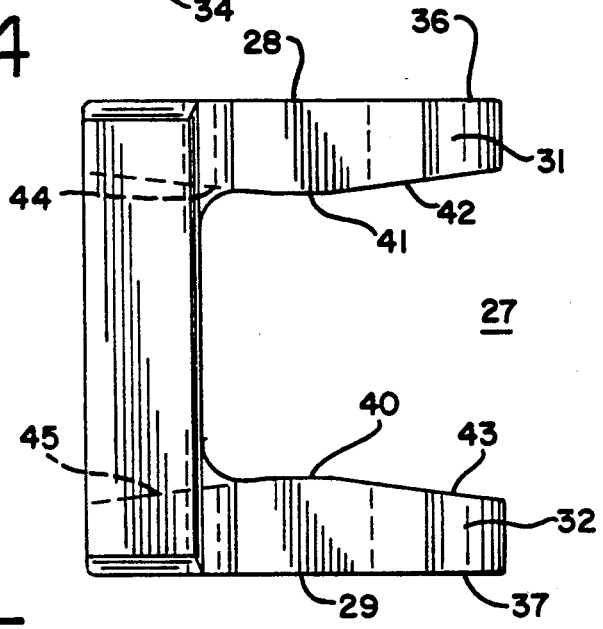
FIG. 4 is a side elevation of the short yoke connection.
Figure 5:
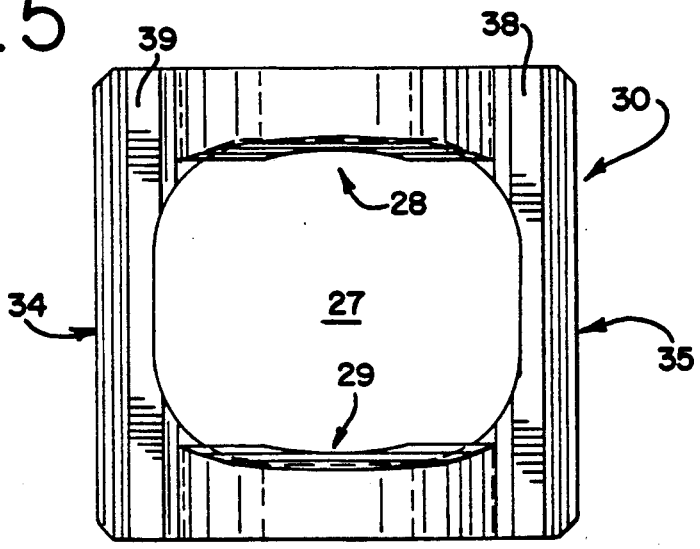
FIG. 5 is a front view of the short yoke connection.

As seen in FIGS. 1 and 2, a vertical pin slackless drawbar coupler arrangement is shown generally at 5. Drawbar 12 extends along its longitudinal axis within the open end 11 of a car center sill 10 which is secured longitudinally beneath the railway car. The center sill 10 is of standard construction comprising an inverted U-shaped channel member having a top wall 8, side walls 21 and 22 and out-turned flanges 20 and 23 at the lower open bottom 9 of the inverted U-shape. Drawbar 12 has an opening or pin hole 14 extending through and normal to its longitudinal axis, opening 14 formed by concave inner curved surface 15. Drawbar butt end 16 has an outer convex surface 17 and an inner concave surface 18. Pin 25 is an elongated bar having cylindrical edge surface 26 in mating engagement with cylindrical surface 27 of opening 28 in the short yoke casting 30. Pin bearing block 80 has a concave cylindrical front surface 81 that abuts rear convex edge surface 19 of pin 25 and has an outward convex back surface 82 which abuts inner curved surface 18 of drawbar butt end 16.

Pocket casting 46 fits within the car center sill 10 at a predetermined longitudinal spacing from the back wall 33 of short yoke casting 30. Pocket casting 46 has a generally flat but sloped interior rear wall 47, a bottom interior surface 49 and an exterior rear wall surface 48 which abuts the front face 71 of spacer block 70. Follower block 50 is located within pocket casting 46 and has a concave front surface 51 that abuts convex curved surface 17 of drawbar butt section 16. Follower block 50 also has a rear surface 52 and a bottom surface 57 which rests on bottom surface 3 of pocket casting 46 to keep concave front surface 51 of follower block 50 symmetrical with pin hole 14 of drawbar 12. Wedge shaped shim 60 has a generally flat front surface 62 that abuts generally flat rear surface 52 of follower block 50 and shim 60 also has a generally flat rear surface 64 that abuts interior rear wall 47 of pocket casting 46. The center sill side walls 21 and 22 are provided with access slots (not shown) which allow the wedge 60 to be held up for installation purposes. Rear wall 48 of pocket casting 46 bears against the front face 71 of spacer 70. Spacer block member 70 is a rigidly fabricated rectangular housing which includes rigid frame members that are capable of withstanding the impact loads to which the center sill 10 is subjected. Spacer block 70 consists of two vertical plates 74, 75 of substantial strength, held in a spaced parallel relationship from each other by cross-plate members 76 and 77. Vertical plate members 74, 75 project upwards from the open bottom 9 of center sill 10 to abut inside surface 4 of center sill top wall 8. Cross-plate members 76 and 77 are not of substantial strength and are vertically centered between the height of spacer block member 70. Spacer 70 replaces the yoke member and draft gear (not shown) which are used when a standard coupler arrangement is used. Back face 72 of spacer 70 abuts the center sill rear stops 90 and 91 of the car center sill 10. Instead of using a spacer member 70, the pocket casting 46 can be cast as one long piece such that the pocket casting in effect, has a built-in spacer section so that pocket casting rear wall 48 abuts the rear stops 90 and 91. Due to dimensional irregularities in cast members, it is preferred to use the standard pocket casting member 46 along with the fabricated spacer member 70.

According to the present invention, the drawbar 12 is centered vertically, laterally, and longitudinally within the center sill 10 by a single unitary short yoke connection member 30, which extends laterally within the center sill 10 and fits completely about a longitudinal portion of the butt end 16 of drawbar 12. The butt end 16 of the drawbar passes through a passageway or cavity 27 of short yoke member 30.

Unitary short yoke member 30 consists of top flange 31, bottom flange 32 and back wall 33. Short yoke member 30, when assembled, fits within the center sill 10 with the back wall side edges 34 and 35 contacting center sill inside walls 2 and 3, thereby controlling the lateral movement of the drawbar assembly. Outside flange surfaces 36 and 37 of the short yoke connection 30, contact inner top sill wall 4 and inside surface 105 of support channel 120 respectively, support channel 120 being bolted to the out-turned flanges 20 and 23 of center sill 10. Top and bottom flanges 31 and 32 each include substantially planar, substantially horizontal drawbar contact surfaces 40 and 41. The drawbar contact surface 40 includes a sloped front section 42 and a sloped rear section 43, while drawbar contact surface 41 has a sloped front section 44 and a sloped rear section 45. Contact surface sections 42, 43, 44 and 45 are sloped on individual planes at acute angles from the plane which passes along the horizontal portions of the contact surfaces 41 and 42, to provide clearance for the slight vertical angling of drawbar 12 within the center sill 10 which occurs during service. Top and bottom flanges 31 and 32 of the short yoke member 30 also include vertical bores 28 and 29 respectively, which are aligned with each other. Openings 28 and 29 are shaped to receive the vertical connecting pin 25 which connects the drawbar 12 to the short yoke member 30. The vertical connecting pin 25 passes through the both openings 28 and 29 in the short yoke member 30 as well as the opening 14 in drawbar 12.

The short yoke member 30 has back wall front faces 38 and 39 which abut the outer surfaces 110 and 111 of the center sill front stops 100 and 102 on the end sill member 150. The striker members 100 and 102 may be integral with a standard end sill casting or be fabricated and then rigidly secured to the center sill 10 by welding or bolting, etc. The front faces 38 and 39 are deeply chamferred to reduce the moment of fillets **38*a* and 39*a* the mating edges of top and bottom flanges 31, 32 with rear wall 33 (shown as a fillet), thereby reducing the stress at the fillet during the transfer of forces from the short yoke member 30 into the front stops 100 and 102**.

In order to pass the spherical butt end 16 of the drawbar 12 through the passageway 140 of the end sill casting member 150, the front stops 100 and 102 have arcuate cut-outs 104 and 106 which will allow passage of the largest diameter of the drawbar 12 there through while still providing the maximum possible cross-sectional area for load transfer from the front faces 38 and 39 on the short yoke member 30.

The opening 14 in the drawbar 12 has a first concave vertical side 15 adapted to receive the front edge 26 of the vertical connecting pin 25 and a second side 18 which is also spherically contoured to correspond in shape to the pin bearing block 80, the second side being formed on the butt end 16 of the drawbar 12. The drawbar opening 14 retains therein a correspondingly shaped pin bearing block 80 which has a first concave vertical side 81 adapted to receive the rear edge 19 of the vertical cylindrical connecting pin 25 and a second side 82 which is correspondingly shaped to be received by a complementary spherically contoured rear surface 18 of the drawbar butt end 16. The aforementioned arrangement of vertical connecting pin 25, pin bearing block 80, short yoke member 30 and follower block 16, permits vertical and horizontal angling of the drawbar 12 within the center sill 10.

The vertical connecting pin 25 and short yoke member 30 are held in place at the open bottom 9 of the center sill 10 by a support channel 120 which is bolted to the out turned flanges 20 and 23 of the center sill 10.

During service, the longitudinal draft loads from the drawbar 12 are transmitted by the vertical connecting pin 25 to the short yoke member 30. The short yoke member 30, in turn, transmits the longitudinal draft loads through the interface between the front faces 38 and 39 on the short yoke 30 into the front faces 110 and 111 on the end sill front stops 100 and 102 and then into the center sill 10. The buff loads from the drawbar 12 are transmitted directly to the follower block 50, tapered wedge 60 and pocket casting 46, then into the spacer member 70 before finally being transferred into center sill rear stops 90 and 91. No buff loads are taken by the vertical connecting pin 25 or the short yoke member 30.

When the longitudinal draft loads are transferred from the vertical connecting pin 25 to the short yoke member 30, a much larger surface area is utilized than in the horizontal draft key and sill side castings of the prior art. The area of contact in the prior art extended along the linear arcuate front edge of the horizontal draft key only. In the present vertical pinned invention, the area of contact is increased greatly due to the greater interaction of areas 38 and 39 with 110 and 111 respectively, resulting in reduced stress concentration in the center sill 10 and the connecting pin 25, in general.

The arrangement of the present invention can thus adequately handle the load transfer between the drawbar 12 and the center sill 10 without the necessity of rigidly attaching, usually by welding, the short yoke member 30 to the center sill 10.

Welding is eliminated due to an arrangement that is easy to install and remove for railway car conversion. The method of construction comprises: placing the spacer member 70 and the pocket casting 46 within the center sill 10 so that they are pushed against the rear stops 90 and 91, and then securing them to the center sill 10 by bolting support plate member 160 to the out-turned flanges 20 and 23; placing the wedge 60 against pocket casting rear surface 47 but keeping the wedge in a raised position; installing the follower 16 within the pocket casting 46; placing the short yoke member 30 within the center sill 10 so that short yoke member 30 is pushed against front stops 100 and 102, and then temporarily securing member 30 to the center sill 10 by loosely bolting support channel 120 to the out-turned flanges 20 and 23; assembling the pin bearing block 80 in the end of the drawbar 12, then passing the butt end 16 of the drawbar 12 through the short yoke member 30 and into contact with the follower block 16; installing a pry bar (not shown) into slot 180, thereby holding the drawbar in place; removing the support channel 120 and then inserting the vertical connecting pin 25 through the retention member openings 28 and 29, as well as drawbar opening 14 in which pin bearing block 80 is already in place; and again attaching support channel 120 across the open bottom 9 of the center sill 10 to hold the short yoke member 30 and the vertical connecting pin 25 within the center sill; removing the pry bar and then letting the wedge 60 drop into place within the pocket casting 46. To remove the arrangement, the reverse is performed.

What is claimed is:

1. A center sill short yoke member for use with a slackless drawbar connection of a railway car, said short yoke member for laterally and vertically positioning a drawbar member evenly within a center sill without requiring modifications to the end sill, the improvement comprising:

a vertically disposed back wall and horizontally disposed top and bottom walls, said top and said bottom walls having front and back edges respectfully, said back wall having a top and bottom front face, a rear face, and a pair of side edges, said top and said bottom wall back edges being connected to said back wall top and bottom front faces respectfully;

said top and bottom walls being centered between said back wall side edges, said back wall side edges contacting said inside surfaces of said center sill side walls, said back wall having a substantial opening centered between said top and bottom walls and said side edges said top and bottom walls having circular vertical openings, said openings being in alignment, said back wall being greater in horizontal extent than said top and bottom walls, said top, bottom and back walls defining a cavity.

2. The invention according to claim 19 wherein said top and bottom walls include inside surfaces facing said cavity, said inside surfaces having arcuately shaped cut-outs.

3. The invention according to claim 2 wherein said top and bottom wall inside surface arcuate cut-outs allow said top and bottom wall to accommodate the butt end of a drawbar member.

4. The invention according to claim 3 wherein said top and bottom walls have hemicircular front edges.

5. The invention according to claim 4 wherein said top and bottom wall include opposed forward facing and rearward facing arcuate cut-outs, said forward facing out-outs are decreasingly tapered between said top and bottom wall front edges and top and bottom wall contact surfaces, said rearward facing cut-outs are increasingly tapered between said top and bottom wall back edges and said top and bottom wall contact surfaces.

6. The invention according to claim 1 wherein said spacer member and said pocket casting are cast as one piece.

7. A method of converting a standard AAR coupler arrangement, operable in a railcar center sill, into a standard slackless drawbar arrangement and maintaining said center sill in an unaltered state, said coupler arrangement includes a draft gear, a yoke, a pocket casting, a wedge shim, and a follower block, said shim and said follower block mounted within said pocket casting, a standard coupler end, a connecting pin and a pin bearing block operable to secure said coupler end to said yoke, said drawbar arrangement includes a standard drawbar, a short yoke having a longitudinally disposed cavity and a pair of aligned vertical bores, a spacer block having a front face and a back face, said drawbar including a butt end with a longitudinal portion having an opening, said center sill mountable on a railcar, which center sill has a first longitudinal axis and an open and front end, said center sill including a horizontally disposed top wall, a first sidewall and a second sidewall connected by said top wall, which first and second sidewalls and said top wall cooperate to define a channel with a second longitudinal axis, which channel has a first sidewall and a inside sidewall, said channel second longitudinal axis generally aligned with said railcar longitudinal axis, a first front stop mounted within said channel on one of said first and second center sill sidewalls, a second front stop mounted within said channel on the other of said first and second center sill sidewalls, each of said first and second front stops opposed to each other in proximity to said center sill open end, a first rear stop mounted within said channel on one of said first and second center sill sidewalls, a second rear stop mounted within said channel on the other of said first and second center sill sidewalls, each said first and second rear stops opposed to each other and positioned in said channel longitudinally displaced from said open end and one of said first and second front stops, the improvement comprising the steps of:

removing said yoke, said draft gear, said connecting pin and said bearing block from said center sill, leaving said center sill intact, including said center sill front and rear stops;

placing said spacer block member and said pocket casting in said center sill with said spacer block front face in contact with said pocket casting and said spacer block face abutting said center sill rear stops;

placing said short yoke laterally within said center sill such that said short yoke abuts said center sill front stops and is fitted completely about said longitudinal portion of said drawbar butt end;

reinserting said follower block and said wedge shim within said pocket casting such that follower block is disposed toward said open end of said center sill and said wedge shim is disposed behind said follower block, said wedge shim partially inserted to provide working slack;

reinserting said pin bearing block within said drawbar butt end opening;

passing said drawbar through said longitudinally disposed short yoke cavity to abut said follower block;

inserting said wedge shim further into said pocket casting, thereby removing all slack from said coupler arrangement.

8. The method of claim 7 further comprising attaching means for support across said open channel of said center sill to secure said short yoke, said pocket casting and said spacer block within said center sill.

9. The method of claim 8 further comprising reinserting said connecting pin simultaneously through said short yoke vertical bores and said drawbar butt end opening, and attaching means for support across said open channel of said center sill for securing said short yoke, said connecting pin, and said drawbar within said center sill without modifying the relative center sill connecting pin location.

10. In a railway car center sill operable to receive a standard AAR coupler, a connecting pin and a pocket casting, an assembly mountable in said center sill to adapt said center sill to receive a railcar drawbar having a butt end with a longitudinal portion, while maintaining said center sill in an unaltered state, which center sill has a first longitudinal axis and, an open and front end, said center sill including a horizontally disposed top wall, a first sidewall and a second sidewall connected by said top wall which first and second sidewalls and said top wall cooperate to define a channel with a second longitudinal axis, which channel has a first sidewall and a second sidewall, said channel second longitudinal axis generally aligned with said railcar longitudinal axis, a first front stop mounted in said channel on one of said first and second center sill sidewalls, a second front stop mounted in said channel on the other of said first and second center sill sidewalls, said first and second front stops opposed to each other in proximity to said center sill open end, a first rear stop mounted in said channel on one of said first and second center sill sidewalls, a second front stop mounted in said channel on the other of said first and second center sill sidewalls, said first and second front stops opposed to each other and positioned in said channel longitudinally displaced from said open end and one of said first and second fronts stops, said assembly comprising:

a short yoke member, which short yoke member has a vertically disposed back wall having a front face with a top and bottom portion, a first side edge and second side edge, each of said side edges contacting one of said first and second center sill sidewalls, said back wall including a medial opening, a horizontally disposed top flange, a horizontally disposed bottom flange, said top and bottom flanges attached to said top and said bottom portions, respectively, of said back wall front face and centered between said back wall first and second side edges, each of said top and bottom flanges including a vertically aligned bore for receiving said connecting pin for connecting said short yoke member to said drawbar, said connecting pin located in said center sill channel longitudinal displaced from said center sill open end at a fixed position when either of said coupler and said drawbar is operable within said center sill, each of said top and bottom flanges having an inside surface with longitudinally oriented acruate cutouts, a substantially planar contact surface proximate to said vertical bores, a front tapered wall thickness and a rear tapered wall thickness, each of said front tapered wall thickness decreasing in a direction from said respective contact surface toward said center sill front stops and each of said rear tapered wall thicknesses decreasing in a direction from said respective contact surface toward said back wall, said top and bottom flange inside surface and said back wall front face cooperating to define a passageway for operably receiving said longitudinal portion of said drawbar butt end;

a spacer block member, including a front face and a rear face, said front face contacting said pocket casting rear wall surface and said rear face contacting said center sill rear stops;

wherein said short yoke member front face contacts said center sill front stops and said follower block contacts said drawbar butt end, whereby buff loads are transferred from said drawbar butt end, said follower block, and said pocket casting through said spacer block member to said center sill rear stops and draft loads are transferred from said drawbar, said connecting pin and said short yoke member, into said center sill front stops.

11. The invention according to claim 10 wherein said spacer block member and said pocket casting are separate pieces.

12. The invention according to claim 10 wherein said spacer block member and said pocket casting are in contact.

13. The invention according to claim 10 wherein said spacer block member is in contact with said rear stops of said center sill.

* * * * *